US010029476B2

(12) United States Patent
Dardona et al.

(10) Patent No.: US 10,029,476 B2
(45) Date of Patent: Jul. 24, 2018

(54) LASER ENHANCEMENTS OF MICRO COLD SPRAY PRINTED POWDER

(71) Applicant: Hamilton Sundstrand Corporation, Charlotte, NC (US)

(72) Inventors: Sameh Dardona, South Windsor, CT (US); Vijay Narayan Jagdale, South Windsor, CT (US); Wayde R. Schmidt, Pomfret Center, CT (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 0 days.

(21) Appl. No.: 15/282,178

(22) Filed: Sep. 30, 2016

(65) Prior Publication Data

US 2018/0093493 A1 Apr. 5, 2018

(51) Int. Cl.
*B41J 2/44* (2006.01)

(52) U.S. Cl.
CPC ..... *B41J 2/442* (2013.01)

(58) Field of Classification Search
CPC ..... B41M 5/24; B41M 5/26; B23K 26/144; B23K 26/1462; B23K 26/1464; B41J 2/1642; B41J 2/1643; B41J 2/1645; B41J 2/1646; B41J 2/475; B41J 2/455; B41J 2/45; B41J 2/44
See application file for complete search history.

(56) References Cited

U.S. PATENT DOCUMENTS 5,691,989 A * 11/1997 Rakuljic ..... G02B 5/32 359/15
5,993,549 A * 11/1999 Kindler ..... B05B 7/22 118/308
6,449,103 B1 * 9/2002 Charles ..... G02B 13/06 359/366
7,031,573 B2 * 4/2006 Volodin ..... G02B 6/2931 359/15
7,430,231 B2 * 9/2008 Luo ..... H01S 3/025 372/10
7,522,651 B2 * 4/2009 Luo ..... H01S 3/042 372/72
9,570,874 B1 * 2/2017 Ghauri ..... B23K 26/0006
9,573,385 B2 * 2/2017 Moench ..... B41J 2/447
2002/0047542 A1 * 4/2002 Higuchi ..... B82Y 10/00 315/111.21
2009/0201952 A1 * 8/2009 Luo ..... H01S 3/10092 372/5
2011/0300306 A1 12/2011 Mohanty
(Continued)

FOREIGN PATENT DOCUMENTS

GB 2439934 A 1/2008

*Primary Examiner* — Patrick King
(74) *Attorney, Agent, or Firm* — Cantor Colburn LLP

(57) ABSTRACT

A micro cold spray printer system having: a printer housing having a longitudinal axis; a transfer tube defining an optical chamber oriented parallel and coaxial to a the longitudinal axis of the housing the optical chamber having an exit; a particle supply inlet fluidly connected to the optical chamber, the particle supply inlet in operation supplying particles to flow through the optical chamber along the longitudinal axis and out the exit; and a laser that in operation emits a laser beam into the optical chamber to heat the particles to a selected temperature. The laser beam is directed at an angle that is not parallel to the longitudinal axis.

20 Claims, 3 Drawing Sheets

(56) References Cited

U.S. PATENT DOCUMENTS

| | | | | |
|---|---|---|---|---|
| 2012/0145683 | A1* | 6/2012 | Miyagi | B23K 26/147 219/121.64 |
| 2013/0176375 | A1* | 7/2013 | Moench | B41J 2/447 347/225 |
| 2013/0319325 | A1* | 12/2013 | Whitfield | B23K 26/34 118/620 |
| 2014/0028998 | A1* | 1/2014 | Kaye | G01J 3/02 356/51 |
| 2014/0370203 | A1 | 12/2014 | Sailer et al. | |
| 2015/0041025 | A1* | 2/2015 | Wescott | B23K 9/042 148/538 |
| 2016/0375521 | A1* | 12/2016 | Sasaki | B23K 26/1476 219/121.17 |
| 2017/0373461 | A1* | 12/2017 | Nogiwa | H01S 3/0941 |

* cited by examiner

LASER ENHANCEMENTS OF MICRO COLD SPRAY PRINTED POWDER

BACKGROUND

The subject matter disclosed herein generally relates to cold spray systems, and more specifically to an apparatus and a method for operating a micro cold spray system.

Advancements in electronic and sensor systems require high performance materials and fabrication methods that permit manufacturing of optimized designs. This requires further miniaturization and integration, while enhancing the functionality and lifetime of existing systems. New strategies in materials formulation and device fabrication are needed in order to eliminate the long lead times required for the fabrication of prototypes and evaluation of new materials and designs. Direct Write (DW) techniques, which do not need photolithographic work, support rapid prototyping, development and testing of new multifunctional materials. DW techniques are complementary to photolithography techniques, allowing for conformal patterning and rapid turnaround.

Micro Cold Spray (MCS) is a variant of both bulk cold spray and aerosol DW which utilizes the cold spray process to deposit fine conductive features for microelectronic applications. MCS differs from cold spray in the types of targeted applications and feature sizes, and differs from aerosol-based DW in the deposition process. The MCS technique is capable of operating at room temperature in air while maintaining sub-mm resolution and does not require post processing such as thermal annealing.

Due to the nature of the cold deposition mechanism, when compared with thermal spray or laser-based processes, MCS offers relatively low oxide content, significantly reduced or elimination of thermally induced stresses, and the ability to coat a variety of substrates, including polymers. However, there are existing challenges associated with MCS printing which include: (1) relatively high operating costs due to the use of expensive gases like helium, (2) reduced bond strength and density for hard materials, such as Titanium alloys, and (3) large compressive residual stresses attributed to the extremely short timescales available for bonding.

SUMMARY

According to one embodiment, a micro cold spray printer system is provided. The micro cold spray printer system having: a printer housing having a longitudinal axis; a transfer tube defining an optical chamber oriented parallel and coaxial to a the longitudinal axis of the housing the optical chamber having an exit; a particle supply inlet fluidly connected to the optical chamber, the particle supply inlet in operation supplying particles to flow through the optical chamber along the longitudinal axis and out the exit; and a laser that in operation emits a laser beam into the optical chamber to heat the particles to a selected temperature. The laser beam is directed at an angle that is not parallel to the longitudinal axis.

In addition to one or more of the features described above, or as an alternative, further embodiments of the micro cold spray printer system may include that the transfer tube includes a transparent portion located where the laser beam enters the optical chamber. The transparent portion in operation focusing the laser beam by a selected increment.

In addition to one or more of the features described above, or as an alternative, further embodiments of the micro cold spray printer system may include a multi-pass cell encompassing a portion of the transfer tube, the multi-pass cell in operation redirecting the laser beam at a reflection point.

In addition to one or more of the features described above, or as an alternative, further embodiments of the micro cold spray printer system may include that the multi-pass cell in operation redirects the laser beam at each reflection point such that the laser beam is confined to a predetermined section of the transfer tube.

In addition to one or more of the features described above, or as an alternative, further embodiments of the micro cold spray printer system may include that the laser is mounted on the printer housing.

In addition to one or more of the features described above, or as an alternative, further embodiments of the micro cold spray printer system may include that the laser beam is transferred from the laser to the optical chamber through a fiber optic cable.

In addition to one or more of the features described above, or as an alternative, further embodiments of the micro cold spray printer system may include that the particles include a coating that in operation enhances energy absorption from the laser beam.

According to another embodiment, a method of applying a coating of particles to a substrate is provided. The method having the steps of: supplying particles to a micro cold spray printer system through a particle supply inlet within a printer housing, the printer housing having longitudinal axis; accelerating the particles through a transfer tube and out an exit of the transfer tube towards the substrate, the transfer tube defining an optical chamber oriented parallel and coaxial to a longitudinal axis; and emitting a laser beam into the optical chamber to heat the particles to a selected temperature using a laser as they pass through the transfer tube. The laser beam is directed at an angle non-parallel to the longitudinal axis.

In addition to one or more of the features described above, or as an alternative, further embodiments of the method of applying a coating of particles to a substrate may include focusing the laser beam by a selected increment using a transparent portion, in the transfer tube, the transparent portion located where the laser beam enters the optical chamber.

In addition to one or more of the features described above, or as an alternative, further embodiments of the method of applying a coating of particles to a substrate may include redirecting the laser beam at a reflection point using a multi-pass cell encompassing a portion of the transfer tube.

In addition to one or more of the features described above, or as an alternative, further embodiments of the method of applying a coating of particles to a substrate may include that the multi-pass cell in operation redirects the laser beam at each reflection point such that the laser beam is confined to a predetermined section of the transfer tube.

In addition to one or more of the features described above, or as an alternative, further embodiments of the method of applying a coating of particles to a substrate may include that the laser is mounted on the printer housing.

In addition to one or more of the features described above, or as an alternative, further embodiments of the method of applying a coating of particles to a substrate may include that the laser beam is transferred from the laser to the optical chamber through a fiber optic cable.

In addition to one or more of the features described above, or as an alternative, further embodiments of the method of applying a coating of particles to a substrate may include that enhancing energy absorption from the laser beam by the particles using a coating on the particles.

According to another embodiment, a method of assembling a micro cold spray printer system is provided. The method of assembling the micro cold spray printer system having the steps of: forming a printer housing having longitudinal axis and a longitudinal hole oriented parallel and coaxial to the longitudinal axis; inserting a transfer tube into the longitudinal hole, the transfer tube defining an optical chamber having an exit; fluidly connecting a particle supply inlet to the optical chamber, the particle supply inlet in operation supplies particles to flow through the optical chamber along the longitudinal axis and out the exit; and operably connecting a laser to the printer housing, the laser in operation emits a laser beam into the optical chamber heating the particles to a selected temperature. The laser beam is directed at an angle non-parallel to the longitudinal axis.

In addition to one or more of the features described above, or as an alternative, further embodiments of the method of assembling a micro cold spray printer system may include that the transfer tube further includes a transparent portion located where the laser beam enters the optical chamber, the transparent portion in operation focusing the laser beam by a selected increment.

In addition to one or more of the features described above, or as an alternative, further embodiments of the method of assembling a micro cold spray printer system may include positioning a multi-pass cell to encompass a portion of the transfer tube, the multi-pass cell in operation redirecting the laser beam at a reflection point.

In addition to one or more of the features described above, or as an alternative, further embodiments of the method of assembling a micro cold spray printer system may include that the multi-pass cell in operation redirects the laser beam at each reflection point such that the laser beam is confined to a predetermined section of the transfer tube.

In addition to one or more of the features described above, or as an alternative, further embodiments of the method of assembling a micro cold spray printer system may include mounting the laser on the printer housing.

In addition to one or more of the features described above, or as an alternative, further embodiments of the method of assembling a micro cold spray printer system may include connecting the laser through a fiber optic cable to the optical chamber.

Technical effects of embodiments of the present disclosure include heating micro cold spray powder particles with a laser prior to impacting a substrate.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

The detailed description explains embodiments of the present disclosure, together with advantages and features, by way of example with reference to the drawings.

DETAILED DESCRIPTION

Figure 1:
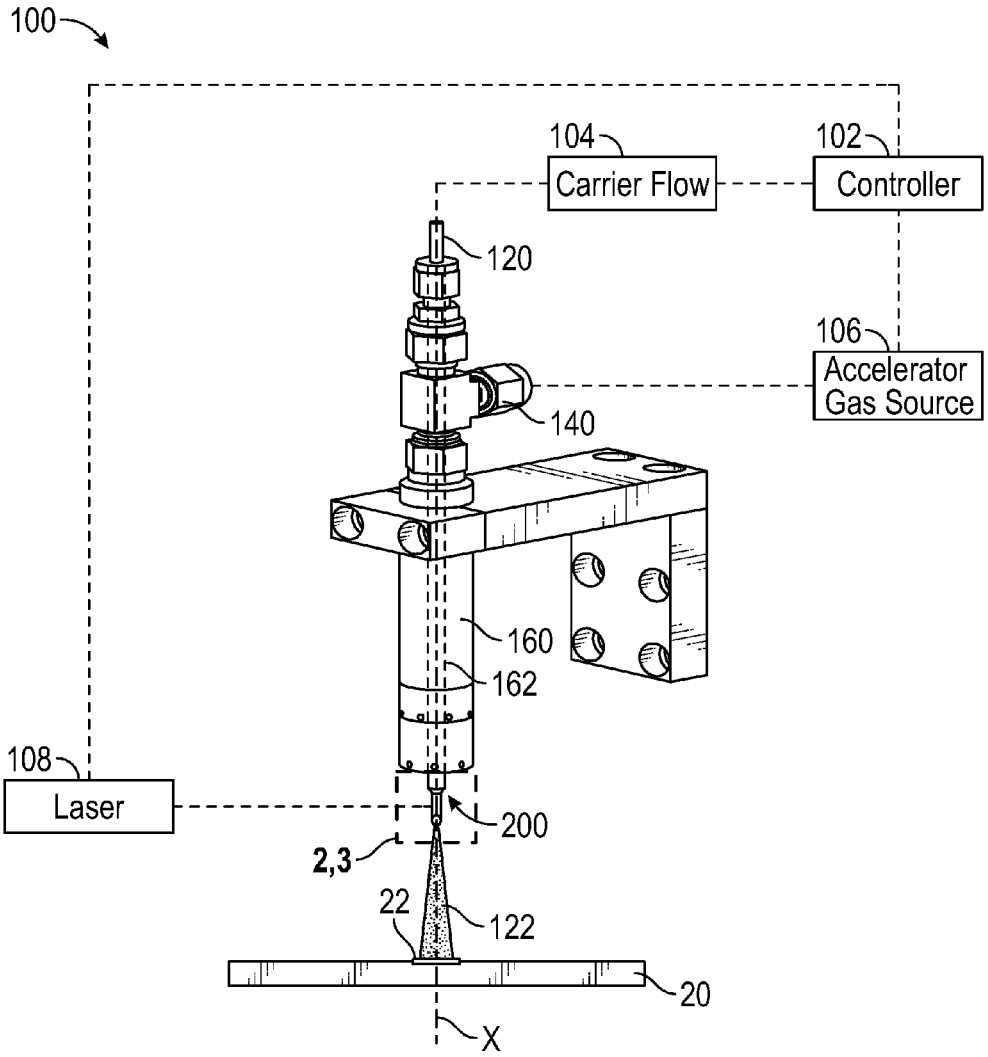
FIG. 1 is a perspective view of a micro cold spray printing system, according to an embodiment of the present disclosure.
Figure 2:
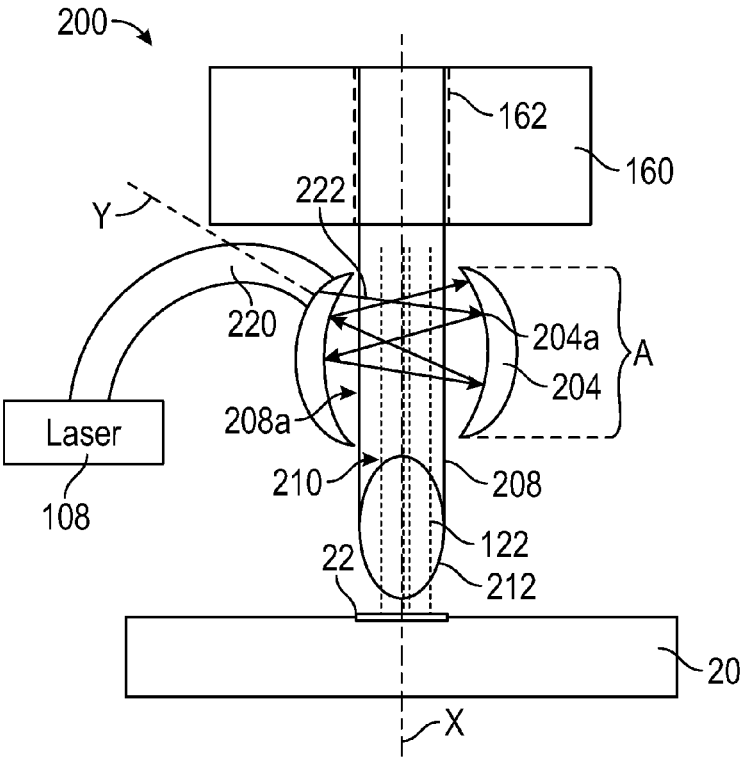
FIG. 2 is an enlarged longitudinal view of a printer head for use in the micro cold spray printing system of FIG. 1, according to an embodiment of the present disclosure.
Figure 3:
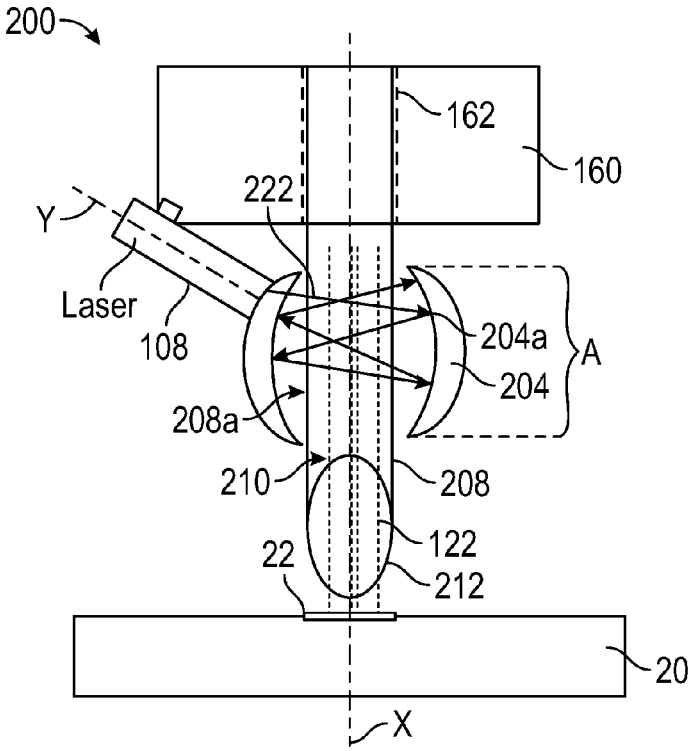
FIG. 3 is an enlarged longitudinal view of a printer head for use in the micro cold spray printing system of FIG. 1, according to an embodiment of the present disclosure.

Referring now to FIGS. 1-3, a micro cold spray printing system 100 is illustrated, according to an embodiment of the present disclosure. The micro cold spray printing system 100 can be used for applying a coating 22 of particles 122 to a substrate 20. As seen in FIG. 1, the micro spray printing system includes a controller 102, a carrier flow 104, an accelerator gas source 106, a laser 108, a printer head 200, and a printer housing 160. The printer housing 160 includes particle supply inlet 120, an accelerator gas inlet 140, and a longitudinal axis X. The printer housing 160 also includes a longitudinal hole 162 oriented parallel and coaxial to the longitudinal axis X. As may be appreciated by one of skill in the art, the longitudinal hole 162 may be various shapes and dimensions to achieve the desired particle 122 flow and focusing characteristics. The carrier flow 104 may comprise both a gas and powder that compose the particles 122 to be coated 22 on the substrate 20. The carrier flow 104 may include one or more powder sources and transport mechanisms (i.e. screw auger, mechanical agitation) to help move the powder.

Within the longitudinal hole 162 resides a transfer tube 208 defining an optical chamber 210. The transfer tube 208 is oriented parallel and coaxial to a longitudinal axis X, as seen in FIGS. 2-3. As may be appreciated by one of skill in the art, the transfer tube 208 may be various shapes and sizes to achieve the desired particle 122 flow characteristics. The optical chamber 210 is fluidly connected to the particle supply inlet 120 to receive particles 122 from the particle source 104. The optical chamber 210 is also fluidly connected to the accelerator gas inlet 140 to receive accelerator gas from the accelerator gas source 106. The particle supply inlet 120 in operation supplies particles 122 to flow through the optical chamber 210 along the longitudinal axis X and out an exit 212 towards the substrate 20.

As mentioned above, the micro cold spray printing system 100 also includes a laser 108. The laser 108 in operation emits a laser beam 222 into the optical chamber 210 and heats the particles 122 to a selected temperature.

Advantageously, heating only the particles and not the substrate softens the particles and improves adhesion with no damage to substrate, which enable low cost and rapid manufacturing of functional sensing and other devices on low-temperature substrates. As a result, substrates having lower temperature capability can be used to directly print electronic materials. Controlled heating of the particles reduces or eliminates the need to heat the substrate upon which the powder is delivered. The ability to control the temperature of the particles also enables deposition of particles of different materials on the same substrate sideby-side or on top of each other providing multi-material deposition ability. Further advantageously, the disclosed embodiment allows for printing of relatively hard materials with low residual stress.

In an embodiment, the laser beam 222 may be delivered at a selected wavelength to maximize heat absorption by the particles. In an embodiment, the laser beam 222 is directed at an angle that is non-parallel to the longitudinal axis X and thus enters the optical chamber 210 along axis Y, as seen in FIGS. 2-3. Axis Y may be at a selected non-parallel angle in relation to the longitudinal axis X. Advantageously, by directing the laser beam 222 at an angle that is non-parallel to the longitudinal axis X, the laser 108 can avoid inadvertently heating the substrate by direct contact with the laser beam 222 and minimizes reflection (losses) at the plane of entry. In the embodiment of FIG. 2, the laser 108 may be located off the printer housing 160 and the laser beam 222 transferred from the laser 108 to the optical chamber 210 through a fiber optic cable 220. In the embodiment of FIG. 3, the laser 108 is mounted on the printer housing 160. As may be appreciated by one of skill in the art, the strength, wavelength, exposure time, diameter, number, power and/or distribution of the laser beam 222 may be adjusted based on variables including but not limited to the powder (particle 122 and gas from carrier flow) composition, architecture (i.e. coated particles 122) as well as particle size, shape, distribution, and desired temperature rise. Also, as may be appreciated by one of skill in the art, the laser 108 and laser beam 222 may be adjusted based on the material of the substrate 20, which may include conductive metals such as, for example, copper, silver, gold, aluminum, related alloys, carbon-containing powders, polymeric materials, and composite powders. Additionally, in an embodiment, the particles 122 may be coated to enhance energy absorption from the laser beam 222 and thus relax the need for multiple wavelengths. The particles 122 may be coated with a material having reflectivity value less than that of the particles 122 to help increase the energy absorption of the laser beam 222. Some coatings may include but are not limited to iron, molybdenum, nickel, tin, titanium, tungsten, zinc, and alloys thereof. Carbonaceous coatings may also preferentially absorb the incoming laser energy. Additionally, increasing the surface roughness of the particle 122 may also increase the amount of energy absorption from the laser beam 222 by the particle 122.

Moreover, in an embodiment, the laser beam 222 may enter the optical chamber 210 through a transparent portion 208*a* in the transfer tube 208, as seen in FIGS. 2-3. In another embodiment, the entire transfer tube 208 may be transparent, thus making the transparent portion 208*a* the entire transfer tube 208. The transparent portion 208*a* and/or entire transfer tube 208 may be composed of a transparent material including sapphire, silica and any other material that allows sufficient energy to be transmitted to the particles known to one of skill in the art. In an embodiment, the transparent portion 208*a* may focus (optically adjusting at least one of strength and width of the laser beam) the laser beam 222 by a selected increment. In an alternative embodiment, the laser beam 222 may be focused by an external lens (not shown). Once the laser beam 222 enters the optical chamber, a multi-pass cell 204 encompassing a portion of the transfer tube 208 may in operation redirect the laser beam 222 at a reflection point 204*a*. The multi-pass cell 204 is configured to bounce (i.e. reflect) the laser beam 222 to increase the absorption of the laser beam 222 by the particles 122. Further, in an embodiment, the multi-pass cell 204 may redirect the laser beam 222 at each reflection point 204*a* such that the laser beam 222 is confined to a predetermined section of the transfer tube 208. In the example of FIGS. 2-3, the predetermined section is section A. In an embodiment, multi-pass cell 204 may use focusing mirrors to redirect the laser beam 222 at each reflection point 204*a*. The multi-pass cell 204 may utilize a single or multiple spherical, symmetric or asymmetric focusing mirrors.

Figure 4:
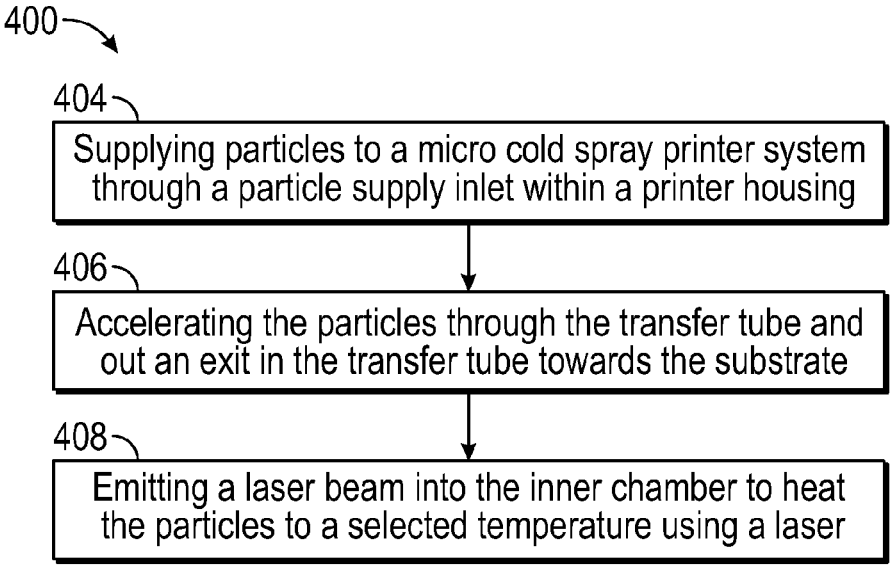
FIG. 4 is a flow process illustrating a method of applying a coating of particles on a substrate, according to an embodiment of the present disclosure.

Referring now to FIG. 4, while referencing components of the micro cold spray printing system 100 of FIGS. 1-3, FIG. 4 shows a flow process illustrating a method 400 of applying a coating 22 of particles 122 to a substrate 20, according to an embodiment of the present disclosure. At block 404, particles 122 are supplied to a micro cold spray printer system 100 through a particle supply inlet 120 within a printer housing 160. As mentioned above, the printer housing 160 has a longitudinal axis. A transfer tube 208 is located within the printer housing 160 and is oriented parallel and coaxial to a longitudinal axis X. The transfer tube 208 defining an optical chamber 210 and having an exit 212. At block 406, the particles 122 are accelerated through the transfer tube 208 and out an exit 212 in the transfer tube 208 towards the substrate 20. At block 408, a laser beam 222 is emitted in the optical chamber 210 to heat the particles 122 to a selected temperature using a laser 108. The laser beam 222 is directed at an angle non-parallel to the longitudinal axis, as seen in FIGS. 2-3.

The method 400 may also include that the laser beam 222 is focused by a selected increment using a transparent portion 208*a* in the transfer tube 208 located where the laser beam 222 enters the optical chamber 210. The method 400 may further include redirecting the laser beam 222 at a reflection point 204*a* using a multi-pass cell 204 encompassing a portion of the transfer tube 208, as mentioned above. The method 400 may also include enhancing energy absorption from the laser beam 222 by the particles 122 using a coating on the particles 122.

While the above description has described the flow process of FIG. 4 in a particular order, it should be appreciated that unless otherwise specifically required in the attached claims that the ordering of the steps may be varied.

Figure 5:
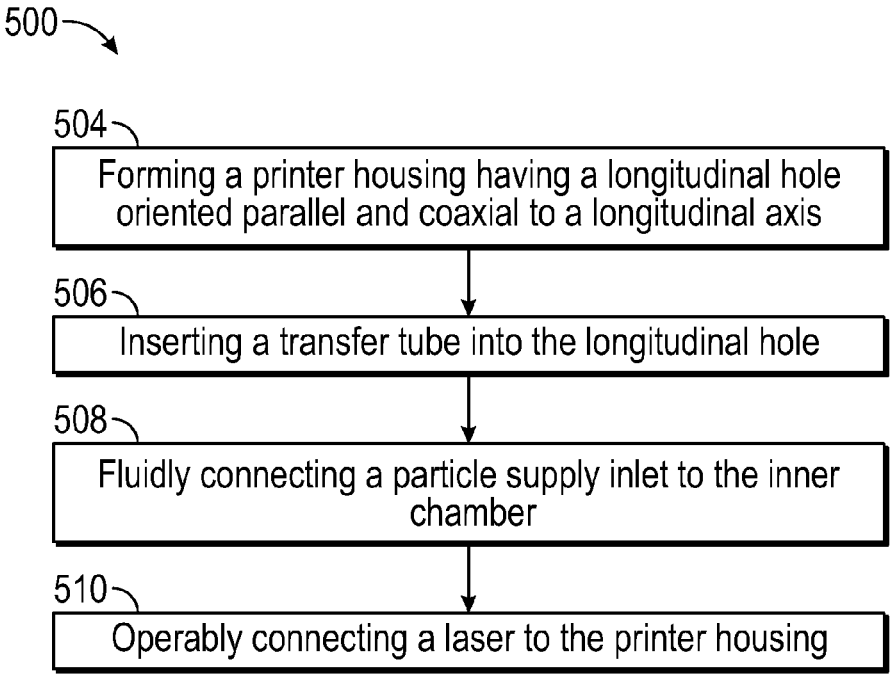
FIG. 5 is a flow process illustrating a method of assembling the micro cold spray printing system of FIGS. 1-3, according to an embodiment of the present disclosure.

Referring now to FIG. 5, while referencing components of the micro cold spray printing system 100 of FIGS. 1-3, FIG. 5 shows a flow process illustrating a method 500 of assembling a micro cold spray printing system 100 of FIGS. 1-3, according to an embodiment of the present disclosure. At block 504, a printer housing 160 is formed having a longitudinal axis and a longitudinal hole 162 oriented parallel and coaxial to the longitudinal axis X. At block 506, a transfer tube 208 is inserted into the longitudinal hole 162. As mentioned above, the transfer tube 208 defines an optical chamber 210 and has an exit 212. At block 508, a particle supply inlet 120 is fluidly connected to the optical chamber 210. As mentioned above, the particle supply inlet 120 in operation supplies particles 122 to flow through the optical chamber 210 along the longitudinal axis X and out the exit 212. At block 510, the laser 108 is operably connected to the printer housing 160. As mentioned above, the laser 108 in operation emits a laser beam 222 into the optical chamber 210 heating the particles 122 to a selected temperature. As also mentioned above, the laser beam 222 is directed at an angle non-parallel to the longitudinal axis X.

The method 500 may also include that a multi-pass cell 204 is positioned to encompass a portion of the transfer tube 208. As mentioned above, the multi-pass cell 204 in operation to redirects the laser beam 222 at a reflection point 204*a*. The method 500 may further include at least one of mounting the laser 108 on the printer housing and connecting the laser 108 through a fiber optic cable 220 to the optical chamber 210. The method 500 may also include coating the particles 122 with a coating that in operation enhances energy absorption from the laser beam 222.

While the above description has described the flow process of FIG. 5 in a particular order, it should be appreciated that unless otherwise specifically required in the attached claims that the ordering of the steps may be varied.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A micro cold spray printer system, the system comprising:

a printer housing having a longitudinal axis;

a transfer tube defining an optical chamber oriented parallel and coaxial to a the longitudinal axis of the housing the optical chamber having an exit;

a particle supply inlet fluidly connected to the optical chamber, the particle supply inlet in operation supplying particles to flow through the optical chamber along the longitudinal axis and out the exit;

a multi-pass cell encompassing a portion of the transfer tube; and a laser that in operation emits a laser beam into the optical chamber to heat the particles to a selected temperature, wherein the laser beam is directed into the optical chamber at an angle that is not parallel to the longitudinal axis, wherein the transfer tube is transparent through the portion of the transfer tube that the multi-pass cell encompasses, and wherein the multi-pass cell in operation redirects the laser beam at one or more reflection points along the portion of the transfer tube that the multi-pass cell encompasses.

2. The micro cold spray printer system of claim 1, wherein the transfer tube includes:

a transparent portion of the transfer tube located where the laser beam enters the optical chamber, the transparent portion of the transfer tube in operation focuses the laser beam by a selected increment.

3. The micro cold spray printer system of claim 1, further comprising:

a multi-pass cell encompassing a portion of the transfer tube, the multi-pass cell in operation redirecting the laser beam at a reflection point.

4. The micro cold spray printer system of claim 3, wherein:

the multi-pass cell in operation redirects the laser beam at each reflection point such that the laser beam is confined to a predetermined section of the transfer tube.

5. The micro cold spray printer system of claim 1, wherein:

the laser is mounted on the printer housing.

6. The micro cold spray printer system of claim 1, wherein:

the laser beam is transferred from the laser to the optical chamber through a fiber optic cable.

7. The micro cold spray printer system of claim 1, wherein:

the particles include a coating that in operation enhances energy absorption from the laser beam.

8. A method of applying a coating of particles to a substrate, the method comprising:

supplying particles to a micro cold spray printer system through a particle supply inlet within a printer housing, the printer housing having longitudinal axis;

accelerating the particles through a transfer tube and out an exit of the transfer tube towards the substrate, the transfer tube defining an optical chamber oriented parallel and coaxial to a longitudinal axis, wherein a multi-pass cell encompasses a portion of the transfer tube; and emitting a laser beam into the optical chamber to heat the particles to a selected temperature using a laser as they pass through the transfer tube;

wherein the laser beam is directed at an angle non-parallel to the longitudinal axis, wherein the transfer tube is transparent through the portion of the transfer tube that the multi-pass cell encompasses, and wherein the multi-pass cell in operation redirects the laser beam at one or more reflection points along the portion of the transfer tube that the multi-pass cell encompasses.

9. The method of claim 8, further comprising:

focusing the laser beam by a selected increment using a transparent portion of the transfer tube located where the laser beam enters the optical chamber.

10. The method of claim 8, further comprising:

redirecting the laser beam at a reflection point using a multi-pass cell encompassing a portion of the transfer tube.

11. The method of claim 10, wherein:

the multi-pass cell in operation redirects the laser beam at each reflection point such that the laser beam is confined to a predetermined section of the transfer tube.

12. The method of claim 8, wherein:

the laser is mounted on the printer housing.

13. The method of claim 8, wherein:

the laser beam is transferred from the laser to the optical chamber through a fiber optic cable.

14. The method of claim 8, wherein:

enhancing energy absorption from the laser beam by the particles using a coating on the particles.

15. A method of assembling a micro cold spray printer system, the system comprising:

forming a printer housing having longitudinal axis and a longitudinal hole oriented parallel and coaxial to the longitudinal axis;

inserting a transfer tube into the longitudinal hole, the transfer tube defining an optical chamber having an exit;

encompassing a portion of the transfer tube in a multi-pass cell;

fluidly connecting a particle supply inlet to the optical chamber, the particle supply inlet in operation supplies particles to flow through the optical chamber along the longitudinal axis and out the exit; and operably connecting a laser to the printer housing, the laser in operation emits a laser beam into the optical chamber heating the particles to a selected temperature;

wherein the laser beam is directed at an angle non-parallel to the longitudinal axis, wherein the transfer tube is transparent through the portion of the transfer tube that the multi-pass cell encompasses, and wherein the multi-pass cell in operation redirects the laser beam at one or more reflection points along the portion of the transfer tube that the multi-pass cell encompasses.

16. The method of claim 15, wherein the transfer tube further includes:

a transparent portion of the transfer tube located where the laser beam enters the optical chamber, the transparent portion of the transfer tube in operation focuses the laser beam by a selected increment.

17. The method of claim 15, further comprising:

positioning a multi-pass cell to encompass a portion of the transfer tube, the multi-pass cell in operation redirecting the laser beam at a reflection point.

18. The method of claim 17, wherein:

the multi-pass cell in operation redirects the laser beam at each reflection point such that the laser beam is confined to a predetermined section of the transfer tube.

19. The method of claim 15, further comprising:

mounting the laser on the printer housing.

20. The method of claim 15, wherein:

connecting the laser through a fiber optic cable to the optical chamber.

* * * * *